US011456134B2

(12) United States Patent
LaFountain et al.

(10) Patent No.: US 11,456,134 B2
(45) Date of Patent: Sep. 27, 2022

(54) MAGNETIC REED SWITCH ASSEMBLY AND METHOD

(71) Applicant: General Equipment and Manufacturing Company, Inc., Louisville, KY (US)

(72) Inventors: Robert L. LaFountain, Scottsburg, IN (US); Michael J. Simmons, Louisville, KY (US)

(73) Assignee: General Equipment and Manufacturing Company, Inc., Louisville, KY (US)

( * ) Notice: Subject to any disclaimer, the term of this patent is extended or adjusted under 35 U.S.C. 154(b) by 0 days.

(21) Appl. No.: 16/738,856

(22) Filed: Jan. 9, 2020

(65) Prior Publication Data

US 2021/0217569 A1 Jul. 15, 2021

(51) Int. Cl.

*H01H 36/00* (2006.01)
*H01H 71/24* (2006.01)
*H01H 51/28* (2006.01)

(52) U.S. Cl.

CPC .... *H01H 36/0006* (2013.01); *H01H 36/0073* (2013.01); *H01H 51/28* (2013.01); *H01H 71/2445* (2013.01); *H01H 2036/0086* (2013.01)

(58) Field of Classification Search

CPC ..... H01H 36/00–36/02
USPC ..... 200/84 C
See application file for complete search history.

(56) References Cited

U.S. PATENT DOCUMENTS 3,685,357 A * 8/1972 Alexander ..... G01F 23/70 73/313
4,210,888 A 7/1980 Holce
4,414,518 A 11/1983 Farr
2013/0169388 A1 7/2013 LaFountain et al.

FOREIGN PATENT DOCUMENTS

DE 34 13 230 A1 10/1985
EP 2 798 653 A1 11/2014
GB 2 251 336 A 7/1992

OTHER PUBLICATIONS

International Search Report and Written Opinion for Application No. PCT/US2021/012624, dated May 10, 2021.

* cited by examiner

*Primary Examiner* — Ramon M Barrera
(74) *Attorney, Agent, or Firm* — Marshall, Gerstein & Borun LLP

(57) ABSTRACT

A magnet reed switch assembly. The magnetic reed switch assembly includes a reed switch having a body and a pair of electrical contacts disposed in the body. A ring magnet has a bore, and a portion of the body of the reed switch is disposed within the bore, with the ring magnet positioned close to the pair of electrical contacts. The ring magnet is movable along the axis of the body between a first position and a second position. A plunger includes a proximal end coupled to the ring magnet and a distal end having a sensing magnet. When a ferrous target is disposed near the sensing magnet, the plunger moves toward the ferrous target causing the ring magnet to move from the first position to the second position, and the reed switch to move from an open state to a closed state.

14 Claims, 7 Drawing Sheets

MAGNETIC REED SWITCH ASSEMBLY AND METHOD

FIELD OF THE DISCLOSURE

This disclosure relates generally to magnetic proximity switches, and, more particularly, to a magnetic reed switch assembly and method.

BACKGROUND

Magnetic proximity switches, also known as limit switches, are commonly used for linear position sensing and in many industries including chemical, petro-chemical, industrial, automotive, and others. Generally, magnetic proximity systems typically include a target and a sensor. In one example, the target passes within a predetermined range of the sensor, and a magnetic flux generated by the target, such as target magnet, causes the switch to close.

Referring to FIGS. 1A-1C, reed switches 10 typically include electrical contacts 12 located within a glass tube 14. The tube 14 forms a hermetic seal 16 with wires 18 (coupled to the electrical contacts 12) extending outside of the tube 14, preventing exposure to the elements, such as gas and liquid, during various operations. In addition, the electrical contacts 12 are positioned so that a presence of a magnetic field disposed on one side of the tube 14 will cause the electrical contacts 12 to change state. For example, the presence of a magnetic field of a separate, target magnet 20 disposed on a side of the tube 14 forces the electrical contacts 12 to come together and contact each other, changing the state of the reed switch to a closed state, as depicted in FIG. 1B. Likewise, the removal of the magnetic field, such as the target magnet, from the side area of the tube 14 allows the electrical contacts 12 to return to their original, non-contacting position, resetting the reed switch 10 back to an open state, as depicted in FIG. 1C.

BRIEF SUMMARY OF THE DISCLOSURE

In accordance with one exemplary aspect of the present invention, a magnetic reed switch assembly may include a reed switch having a tubular body with an axis and a pair of electrical contacts disposed in a center area of the tubular body, the pair of electrical contacts in a non-contacting position in an open state of the reed switch. A ring magnet may have a bore, and a portion of the tubular body of the reed switch may be disposed within the bore, such that the ring magnet is positioned close to the pair of electrical contacts and is movable along the axis of the tubular body between a first position and a second position. A plunger may have a proximal end coupled to the ring magnet and a distal end having a sensing magnet. When a ferrous target is disposed near the sensing magnet, the plunger may move toward the ferrous target causing the ring magnet to move along the axis of the tubular body from the first position to the second position and the reed switch to move from an open state to a closed state in which the pair of electrical contacts are contacting each other.

In accordance with another exemplary aspect of the present invention, a magnetic reed switch may include a body with an axis and a pair of electrical contacts disposed in a center area of the body. The pair of electrical contacts may be movable between a non-contacting position in which the electrical contacts are moved away from each other and a contacting position in which the electrical contacts are in contact with each other. A ring magnet may have a bore, and a portion of the body may be disposed within the bore. The ring magnet may be positioned in a first position near the pair of electrical contacts when the pair of electrical contacts is in the non-contacting position, and the ring magnet may be moved to a second position in response to a presence of a ferrous target. The second position may be closer to the pair of electrical contacts than the first position, causing the pair of electrical contacts to be moved to the contacting position.

In accordance with yet another exemplary aspect of the present disclosure, a method of changing states of a magnetic reed switch may include moving a ferrous target into a sensing area of a sensing magnet coupled to a magnetic reed switch to change a state of the magnetic reed switch, the magnetic reed switch including a body with a portion disposed within a ring magnet. The method may further comprise, in response to the presence of the ferrous target in the sensing area, triggering a closed state of the magnetic reed switch via movement of the ring magnet along an axis of the body of the magnetic reed switch from a first position to a second position and toward the ferrous target. This causes a pair of electrical contacts disposed within the body of the magnetic reed switch to contact each other.

In further accordance with any one or more of the exemplary aspects, the magnetic reed switch assembly, the magnetic reed switch or any method of the present disclosure may include any one or more of the following preferred forms.

In a preferred form, when the ferrous target is moved away from the sensing magnet, the ring magnet may move back to the first position along the axis of the tubular body, and the reed switch may move from the closed state to the open state in which the pair of electrical contacts is in the non-contacting position.

In a preferred form, the magnetic reed assembly may further comprise at least one wire extending outside of the tubular body of the reed switch, and the tubular body may form a seal with the at least one wire.

In a preferred form, the tubular body may include a proximal end and a distal end, and the at least one wire may comprise a first wire extending into the proximal end of the tubular body of the reed switch and be coupled to a first electrical contact of the pair of electrical contacts, and a second wire may extend into the distal end of the tubular body of the reed switch and be coupled to a second electrical contact of the pair of electrical contacts.

In a preferred form, a third wire may extend into the proximal end of the tubular body of the magnetic reed switch and be disposed one or more of adjacent to or below the first wire. The third wire may be coupled to a third electrical contact separate from and in addition to the first and second electrical contacts of the pair of electrical contacts. In addition, the third electrical contact may be in contact with the second electrical contact when the magnetic reed switch is in the open state.

In a preferred form, the magnetic reed switch assembly may further include a housing enclosing the ring magnet, the plunger, and a portion of the reed switch. The housing may include a proximal end and a distal end, with a first housing portion disposed at the distal end, such that a portion of the tubular body of the reed switch may extend outside of the proximal end of the housing, and a portion of the sensing magnet coupled to the distal end of the plunger may be disposed outside of the distal end of the housing. In addition, a second housing portion may be coupled to the first housing portion and include an inside surface limiting movement of the ring magnet.

In another preferred form, the magnetic reed switch assembly may further comprise an offset wire extending from the proximal end of the housing. The offset wire may be adjacent to and offset from the at least one wire extending from the tubular body of the reed switch at the proximal end of the housing. In addition, the offset wire extending from the proximal end of the housing and the at least one wire extending from the tubular body of the reed switch may be disposed parallel to each other.

In a preferred form, the tubular body of the reed switch may comprise glass, and the ferrous target may comprise at least one ferrous material.

In a preferred form, the housing may further include an end portion disposed at the proximal end of the housing. The end portion may have a bore and an inside surface, and the bore may be for receiving a portion of the tubular body of the reed switch. The inside surface may have a hollow projection extending therefrom, and the hollow projection may receive another portion of the tubular body of the magnetic reed switch.

In a preferred form, the ring magnet may be in the first position near the pair of electrical contacts when the reed switch is in an open state, and the ring magnet may be in the second position closer to the pair of electrical contacts than the first position when the reed switch is in a closed state.

In another preferred form, the ring magnet may be adapted to be coupled to a proximal end of a plunger, and the distal end of the plunger may have a sensing magnet.

In a preferred form, the ring magnet may be movable in response to a position of a ferrous target disposed near the sensing magnet.

In a preferred form, when the ferrous target is disposed near the sensing magnet, the ring magnet may be moved along the axis of the body from the first position to the second position closer to the pair of electrical contacts, and when the ferrous target is moved away from the sensing magnet, the ring magnet may be moved along the axis of the tubular body from the second position back to the first position, in which the pair of electrical contacts may be in the non-contacting position.

In a preferred form, the magnetic reed switch may further include at least one wire extending outside of the body of the magnetic reed switch. The body may form a seal with the at least one wire and may include a proximal end and a distal end. The at least one wire may include a first wire extending into the proximal end of the body of the magnetic reed switch and be coupled to a first electrical contact of the pair of electrical contacts. In addition, a second wire may extend into the distal end of the body of the magnetic reed switch and be coupled to a second electrical contact of the pair of electrical contacts.

In a preferred form, the method may include moving the ferrous target away from the sensing area of the sensing magnet coupled to the magnetic reed switch and resetting the magnetic reed switch back to an open state via movement of the ring magnet along the axis of the body from the second position back to the first position, causing the pair of electrical contacts to move away from each other, the pair of electrical contacts including a first electrical contact and a second electrical contact.

In a preferred form, triggering the closed state of the magnetic reed switch via movement of the ring magnet along an axis of a body of the reed switch from a first position to a second position may include one or more of moving the ring magnet closer to the pair of electrical contacts disposed within the body of the magnetic reed switch or a distal end of the body of the magnetic reed switch.

In another preferred form, triggering the closed state of the magnetic reed switch via movement of the ring magnet along an axis of a body of the reed switch from a first position to a second position may include moving the ring magnet in response to the presence of the ferrous target disposed near the sensing magnet from the first position, in which one or more of the pair of electrical contacts are not contacting each other, a third electrical contact is contacting the second electrical contact, and the magnetic reed switch is in an open state, to the second position, in which one or more of the pair of electrical contacts are contacting each other, the second electrical contact is moved away from the third electrical contact, and the magnetic reed switch is in the closed state.

In a preferred form, moving the ferrous target away from the sensing area of the sensing magnet coupled to the magnetic reed switch and resetting the magnetic reed switch back to an open state via movement of the ring magnet along the axis of the body of the magnetic reed switch from the second position back to the first position may include one or more of moving the ring magnet away from the pair of electrical contacts disposed within the body or away from the distal end of the body of the magnetic reed switch.

In another preferred form, moving the ferrous target away from the sensing area of the sensing magnet coupled to the magnetic reed switch and resetting the magnetic reed switch back to an open state via movement of the ring magnet along the axis of the body of the magnetic reed switch from the second position back to the first position may further include moving the ring magnet in response to the absence of the ferrous target from the second position back to the first position in which one or more of the pair of electrical contacts are not contacting each other and the second electrical contact is contacting a third electrical contact, causing the magnetic reed switch to change from the closed state to the open state.

Any one or more of these aspects may be considered separately and/or combined with each other in any functionally appropriate manner. In addition, any one or more of these aspects may further include and/or be implemented in any one or more of the optional exemplary arrangements and/or features described hereinafter. These and other aspects, arrangements, features, and/or technical effects will become apparent upon detailed inspection of the figures and the following description.

BRIEF DESCRIPTION OF THE DRAWINGS

The Figures described below depict various aspects of the system and methods disclosed therein. It should be understood that each figure depicts an example of a particular aspect of the disclosed system and methods, and that each of the figures is intended to accord with a possible example thereof. Further, wherever possible, the following description refers to the reference numerals included in the following figures, in which features depicted in multiple figures are designated with consistent reference numerals.

There are shown in the drawings arrangements which are presently discussed, it being understood, however, that the present examples are not limited to the precise arrangements and instrumentalities shown, wherein.

DETAILED DESCRIPTION

The present disclosure is directed to a magnetic reed switch assembly comprising a reed switch having a pair of electrical contacts movable between a contacting position, in which the reed switch is in a closed state, and a non-contacting position, in which the reed switch is in an open state. A portion of the reed switch is disposed in a ring magnet, such that the ring magnet is movable between a first position disposed near the pair of electrical contacts and a second position disposed closer to the pair of electrical contacts. A proximal end of a plunger is coupled to the ring magnet having a portion of the reed switch, and a distal end of the plunger is coupled to a sensing magnet. When a ferrous target, such as a ferrous material, is disposed near a sensing area of the sensing magnet, the ring magnet is moved from the first position to the second position closer to the electrical contacts, causing the electrical contacts to contact each other, and the reed switch to move from an open state to a closed state. When the ferrous target is removed from the sensing area of the sensing magnet, the ring magnet moves back to the first position, causing the electrical contacts to move away from each other, and the reed switch to move back to the open state.

Figure 1A:
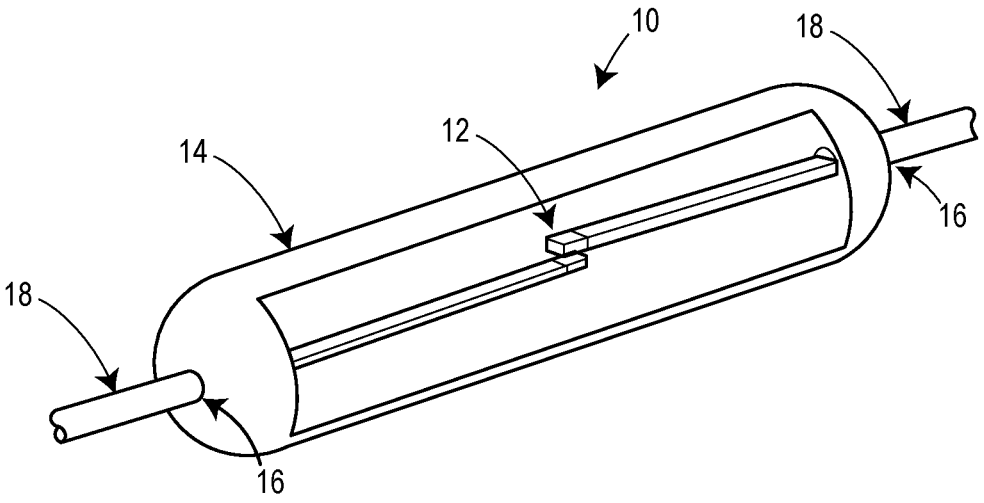
FIGURE 1A (Prior Art)
FIG. 1A is a perspective view of a conventional reed switch.
Figure 1B:
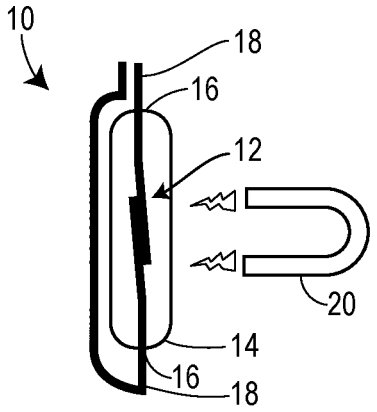
FIGURE 1B (Prior Art)
FIG. 1B is an orthographic view of the conventional reed switch of FIG. 1A in a closed state.
Figure 1C:
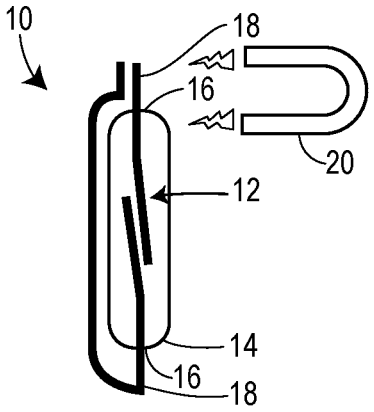
FIGURE 1C (Prior Art)
FIG. 1C is another orthographic view of the conventional reed switch of FIG. 1A in an open state.
Figure 2:
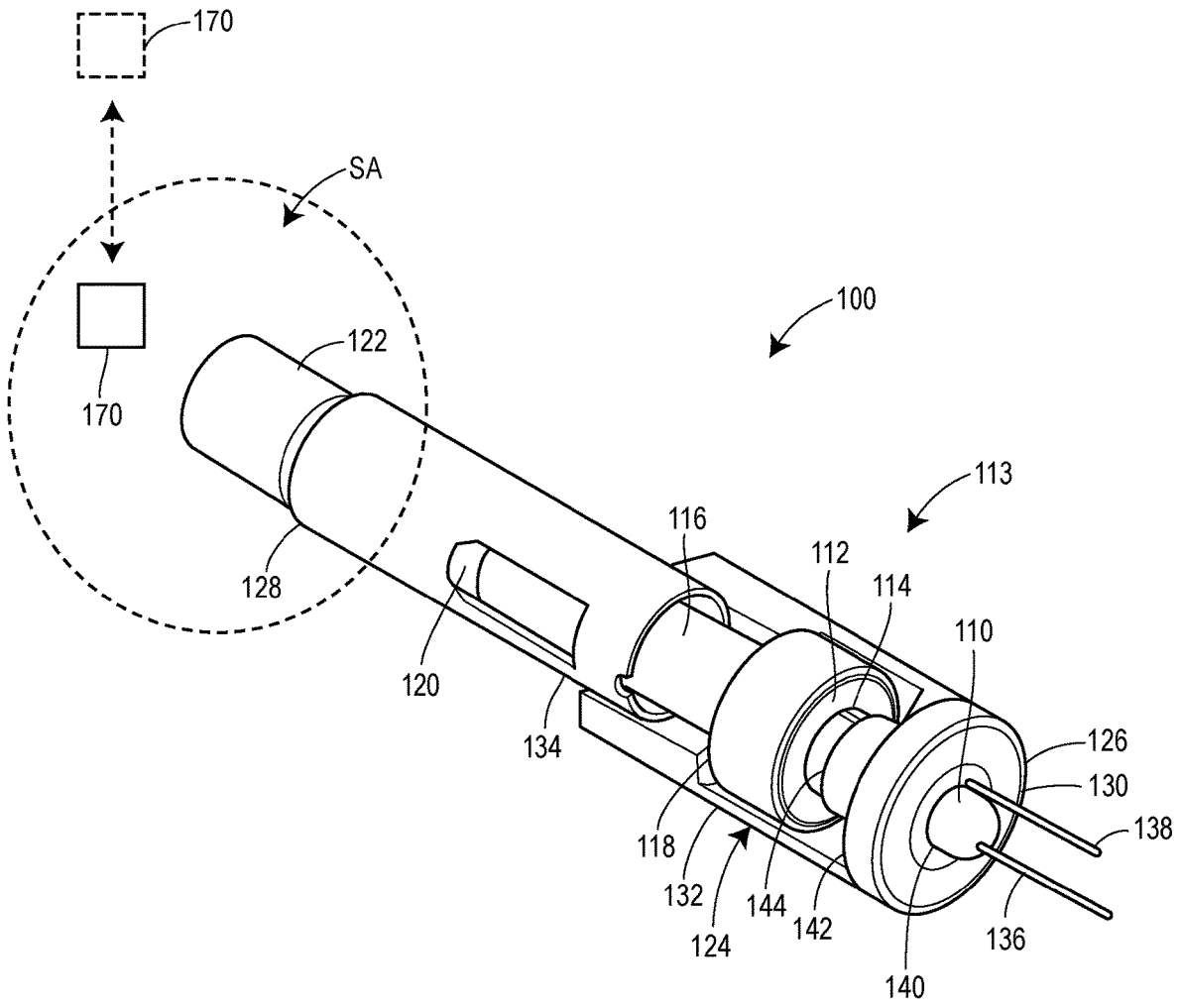
FIG. 2 is an isometric view of a magnetic reed switch assembly of the present disclosure.

Referring now to FIG. 2, a magnetic reed switch assembly 100 according to the present disclosure is depicted. The magnetic reed switch assembly 100 includes a reed switch 110 having a portion disposed in a ring magnet 112. Together, the reed switch 110 and the ring magnet 112 form a magnetic reed switch 113. Specifically, the ring magnet 112 includes a bore 114 in which a portion of the reed switch 110 is disposed, as explained more below. The ring magnet 112 is movable along an axis X of the reed switch 110 between a first position and a second position, as also explained more below.

The magnetic reed switch assembly 100 also includes a plunger 116 having a proximal end 118 coupled to the ring magnet 112 and a distal end 120 having a sensing magnet 122 coupled thereto.

In addition, and in one example, the magnetic reed switch assembly 100 further includes a housing assembly 124 enclosing the ring magnet 112, the plunger 116, and a portion of the reed switch 110. The housing assembly 124 includes a proximal end 126 and a distal end 128, with a first housing portion 130, such as an end portion, disposed at the proximal end 126. A second housing portion 132 is coupled to the first housing portion 130 and disposed around a portion of the plunger 116 and the ring magnet 112 with the portion of the reed switch 110 disposed therein. A third housing portion 134 is coupled to the second housing portion 132 and disposed close to and/or near the distal end 128 of the housing assembly 124.

As further depicted in FIG. 2, a portion of the reed switch 110 extends outside of the proximal end 126 of the housing assembly 124. Further, a portion of the sensing magnet 122 coupled to the distal end 128 of the plunger 116 is disposed outside of the distal end 128 of the housing assembly 124.

As also depicted in FIG. 2, the reed switch 110 further includes at least one wire 136 extending outside of a portion of the reed switch 110 and the proximal end 126 of the housing assembly 124. Further, an offset wire 138 also extends from the proximal end 126 of the housing assembly 124 and is separate from the reed switch 110, in this example. The offset wire 138 is adjacent to and offset from the at least one wire 136 extending from the reed switch 110. In addition, the at least one wire 136 extending from the reed switch 110 and the offset wire 138 are disposed parallel to each other along the same axis X of the reed switch 110.

In one example, the first housing portion 130 may be an end portion 130 of the housing assembly 124. In this example, the end portion 130 includes a central bore 140 for receiving a portion of the reed switch 110 and an inside surface 142. A hollow projection 144 extends from the inside surface 142 of the end portion 130 and receives another portion of the reed switch 110 to further secure the reed switch 110 within the housing assembly 124. As will be appreciated, various other shapes and configurations of the first housing portion 130, such as the end portion 130, may alternatively be used and still fall within the scope of the present disclosure.

Figure 3:
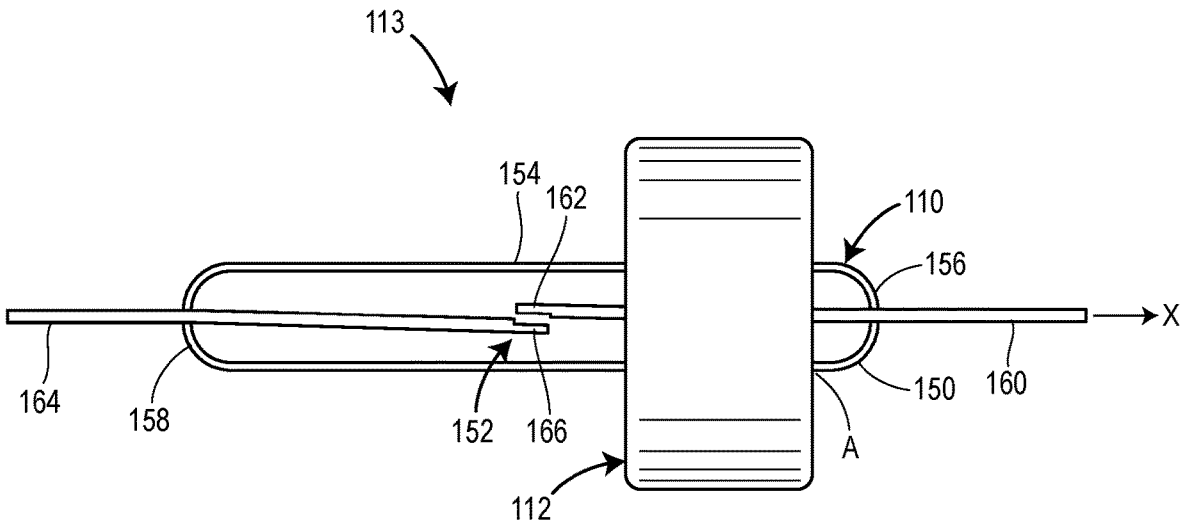
FIG. 3 is a side view of a portion of the magnetic reed switch assembly of FIG. 2, a magnetic reed switch of the magnetic reed switch assembly in an open state.

Referring now to FIG. 3, a portion of the magnetic reed switch assembly 100 of FIG. 2 is depicted, namely the magnetic reed switch 113 including the ring magnet 112 with the portion of the reed switch 110 disposed therein. The reed switch 110 includes a body 150, such as a tubular body, with an axis X and a pair of electrical contacts 152 disposed in a center area 154 in the tubular body 150. Thus, a portion of the tubular body 150 of the reed switch 110 is disposed in the ring magnet 112. In one example, the tubular body 150 comprises glass. Alternatively, the tubular body 150 may comprise various other shapes and/or combinations of shapes other than a tubular shape and the material may include materials other than glass and still fall within the scope of the present disclosure. In addition, in FIG. 3, the pair of electrical contacts 152 is in a non-contacting position, e.g., the electrical contacts are moved away from each other and do not contact one another, and the magnetic reed switch 113 is in an open state. The ring magnet 112 is in a first position A near the pair of electrical contacts 152 when the reed switch 112 is in the open state. The ring magnet is also moveable along the axis X of the tubular body 150 between the first positon A and a second position B (FIG. 4), as explained more below.

As further depicted in FIG. 3, the tubular body 150 includes a proximal end 156 and a distal end 158, and the at least one wire 136 (FIG. 2) comprises a first wire 160 extending into a proximal end 156 of the tubular body 150 of the reed switch 110. The first wire 160 is also coupled to a first electrical contact 162 of the pair of electrical contacts 150. Likewise, a second wire 164 extends into the distal end 158 of the tubular body 150 of the reed switch 110 and is coupled to a second electrical contact 166 of the pair of electrical contacts 152.

Figure 4:
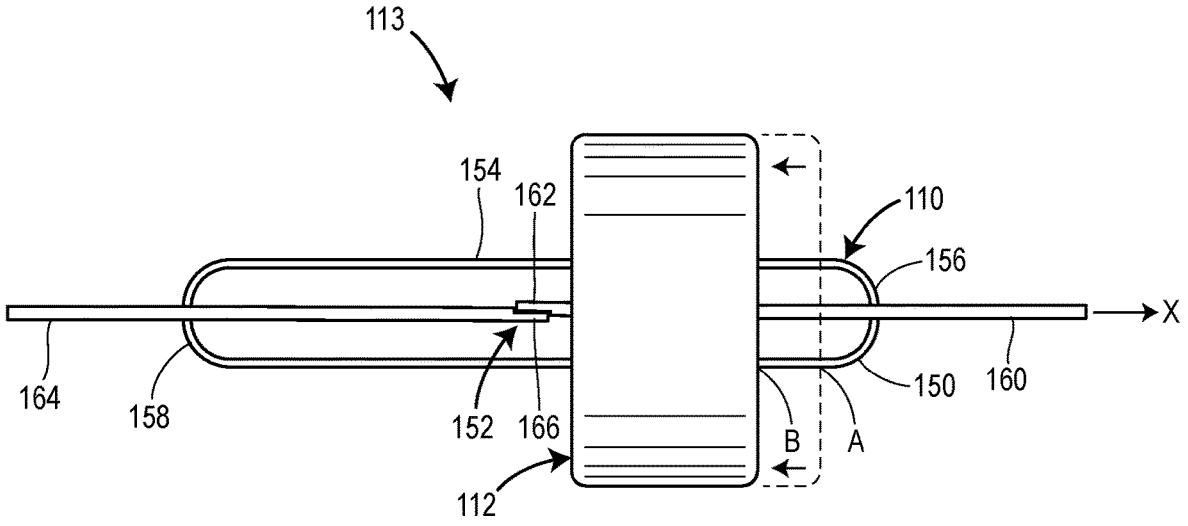
FIG. 4 is another side view of a portion of the magnetic reed switch assembly of FIG. 2, the magnetic reed switch in a closed state.

Referring now to FIG. 4, the ring magnet 112 is depicted in the second position B, which is closer to the pair of electrical contacts 152, and the magnetic reed switch 113 is in a closed state. Specifically, in this example, the ring magnet 112 is moved from the first position A to the second position B in response to the presence of a target 170, such as one or more of ferrous target, a suitable target, or a ferrous material, being disposed in the sensing area SA of the sensing magnet 122 (FIG. 2). The ferrous target and the ferrous material may both include a magnet having a polarity opposite of the polarity of the sensing magnet 122. In addition, the target 170, such as the ferrous material, may have a magnetic permeability (type of material), a mass, and a strength that is sufficient to trigger the magnetic reed switch 113, which may vary depending upon the size and mass of the magnetic reed switch 113, for example. Thus, the target 170 includes a mass sufficient to trigger the magnetic reed switch 113, as will be understood, which is a target suitable to effect such actuation of the magnetic reed switch 113, for example. The second position B is closer to the pair of electrical contacts 152 than the first position A in which the ring magnet 112 is disposed in the open state of the reed switch 110. This causes the pair of electrical contacts 152 to be moved together to the contacting position, and the reed switch 110 to be moved from the open state back to the closed state.

Referring back to FIG. 2, when the ferrous target 170 is disposed in a sensing area SA of the sensing magnet 122, such as near the sensing magnet 122, the plunger 116 is actuated in a direction along the axis X (FIG. 3) toward the ferrous target 170. This actuation causes the ring magnet 112 to move along the axis X of the reed switch 110 from the first position A to the second position B closer to the pair of electrical contacts 152, as depicted in FIG. 4. As a result, the pair of electrical contacts are moved into contact with each other, e.g., are contacting each other, as depicted in FIG. 4, and the reed switch 110 is moved from an open state to a closed state, as again depicted in FIGS. 2 and 4.

When the ferrous target 170 is moved away from the sensing area SA (FIG. 2), the ring magnet 112 is moved along the axis X of the tubular body 150 from the second position B (FIG. 4) back to the first position A, in which the pair of electrical contacts are in the non-contacting position, as depicted in FIG. 3. As a result, the reed switch 110 is moved from the closed state back to the open state in which the pair of electrical contacts 152 is in the non-contacting position, as again depicted in FIG. 3, for example. Thus, the ring magnet 112 is movable between first and second positions A and B in response to a position of the ferrous target 170 disposed near the sensing magnet 122.

Figure 5:
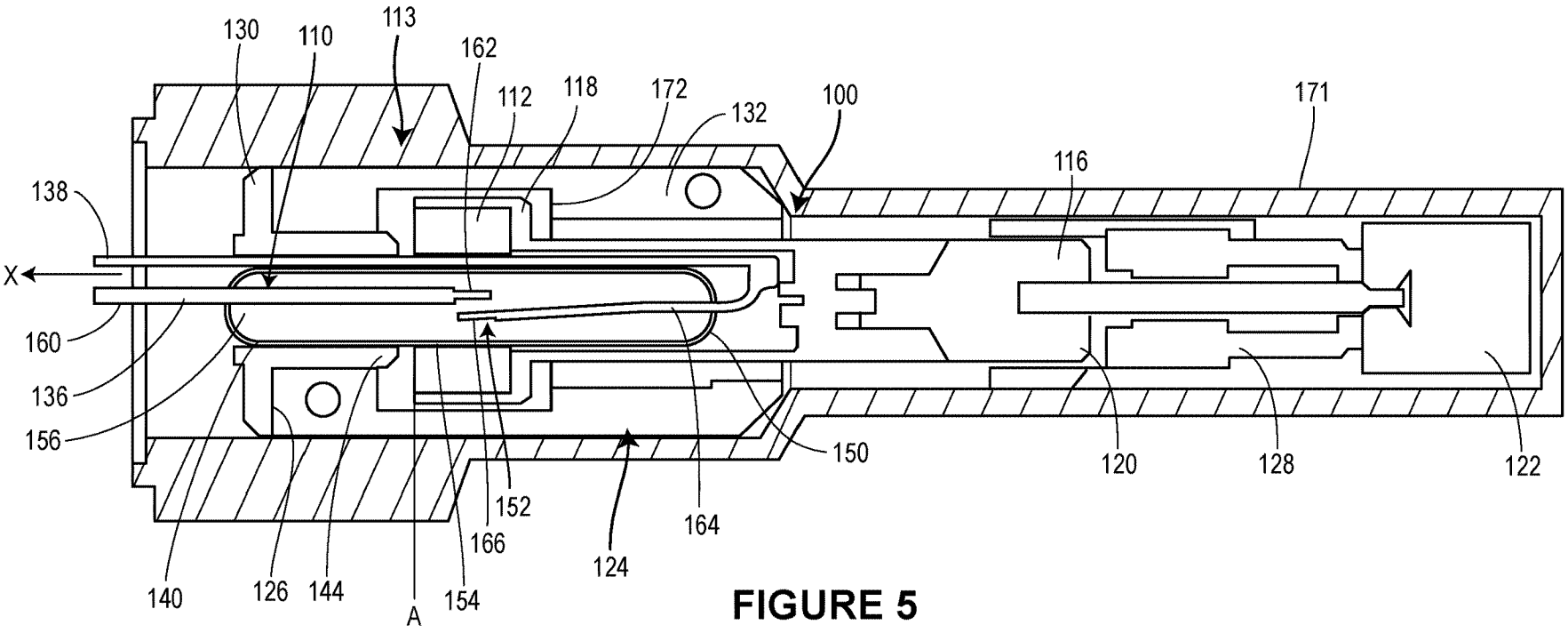
FIG. 5 is a sectional view of the magnetic reed switch assembly of the present disclosure, the magnetic reed switch in an open state.

Referring now to FIG. 5, a sectional view of the magnetic reed switch assembly 100 of FIG. 2 is depicted, with the magnetic reed switch assembly 100 assembled within a TOPWORX GO switch bodytube 171, and the magnetic reed switch 113 is in an open state, such as an unactuated state. In this example, the magnetic reed switch 113 is a single pole single throw (SPST) magnetic reed switch. The magnetic reed switch assembly 100 of FIG. 5 depicts many of the same parts of the magnetic reed switch assembly 100 of FIG. 2, which include the same reference numbers, but are not explained again here for the sake of brevity. Like the open state depicted in FIG. 3, the pair of electrical contacts 152 is in the non-contacting position, e.g., the electrical contacts are moved away from each other and do not contact one another. The ring magnet 112 is again depicted in the first position A near the pair of electrical contacts 152 when the reed switch 112 is in the open state. The ring magnet is also moveable along the axis X of the tubular body 150 between the first positon A and a second position B (FIGS. 4 and 6), as explained above.

As further depicted in FIG. 5, the offset wire 138 is connected to the second wire 164, which is coupled to the second electrical contact 166 of the pair of electrical contacts 152. In addition, the second housing portion 132 includes an inside surface 172 adapted to limit movement of the ring magnet 112 when the ring magnet 112 is moved to the second position B in response to the presence of the ferrous target 170 in the sensing area (e.g., FIG. 6), as explained more below.

Figure 6:
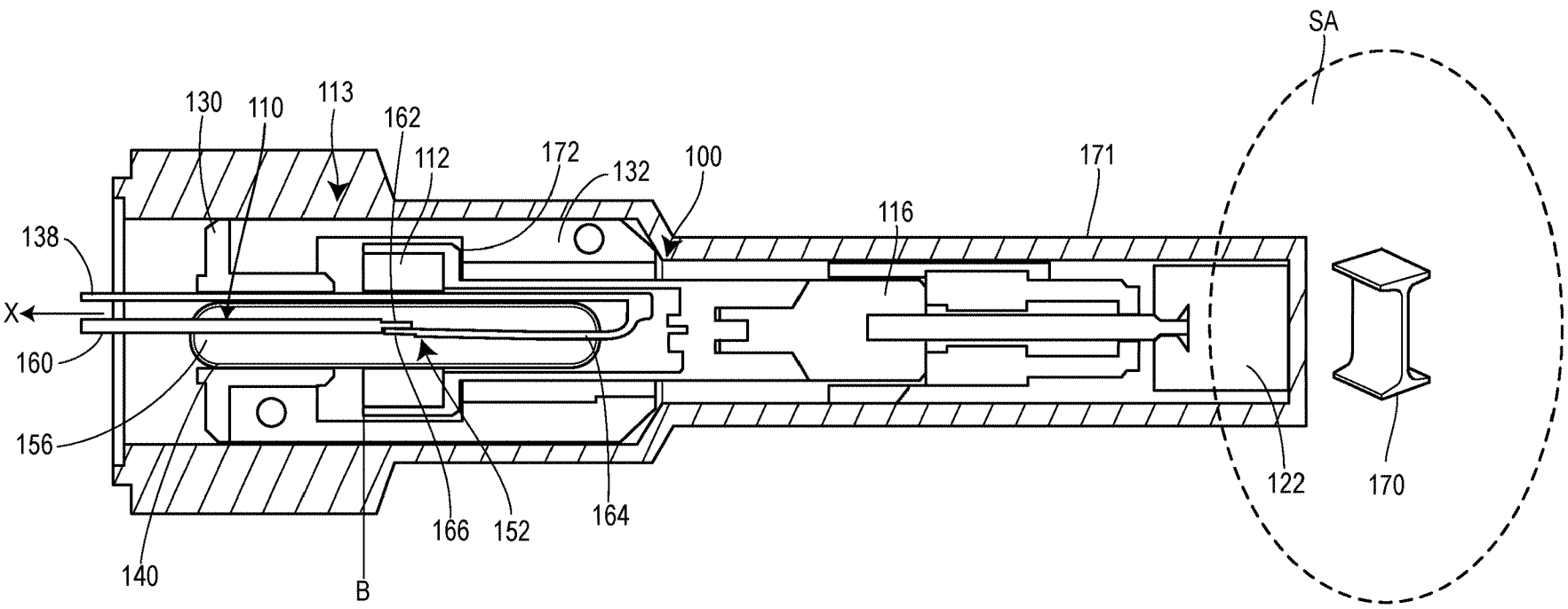
FIG. 6 is a sectional view of the magnetic reed switch assembly of the present disclosure, the magnetic reed switch in a closed state.

Referring now to FIG. 6, a sectional view of the magnetic reed switch assembly 100 of FIG. 2 is depicted, with the magnetic reed switch assembly 100 again assembled within a TOPWORX GO switch bodytube 171, and the magnetic reed switch 113 is in the closed state, which may also be referred to as an actuated state. More specifically, the ring magnet 112 is depicted in the second position B, which is closer to the pair of electrical contacts 152 and the ferrous target 170. In this example, the ring magnet 112 has been moved from the first position A to the second position B in response to the presence of the ferrous target 170, such as ferrous material described above, being disposed in the sensing area SA of the sensing magnet 122. This movement of the ring magnet 112 causes the pair of electrical contacts 152 to be moved together to the contacting position, and the reed switch 110 to be moved from the open state (e.g., of FIG. 5) to the closed state.

As further depicted in FIG. 6, the surface 172 of the second housing portion 132 limits movement of the ring magnet 112. More specifically, the ring magnet 112 moves toward the ferrous target 170 and is stopped by the surface 172 of the second housing portion 132 to maintain the closed state while the ferrous target 170 is in the sensing area SA near the sensing magnet 122.

As described earlier relative to FIG. 2, when the ferrous target 170 is disposed in the sensing area SA of the sensing magnet 122 of FIG. 6, such as near the sensing magnet 122, the plunger 116 is also actuated in a direction along the axis X (FIG. 3) toward the ferrous target 170. This actuation causes the ring magnet 112 to move along the axis X of the reed switch 110 from the first position A to the second position B, and the pair of electrical contacts 152 are moved into contact with each other, such that the magnetic reed switch 113 is in the closed state.

Figure 7:
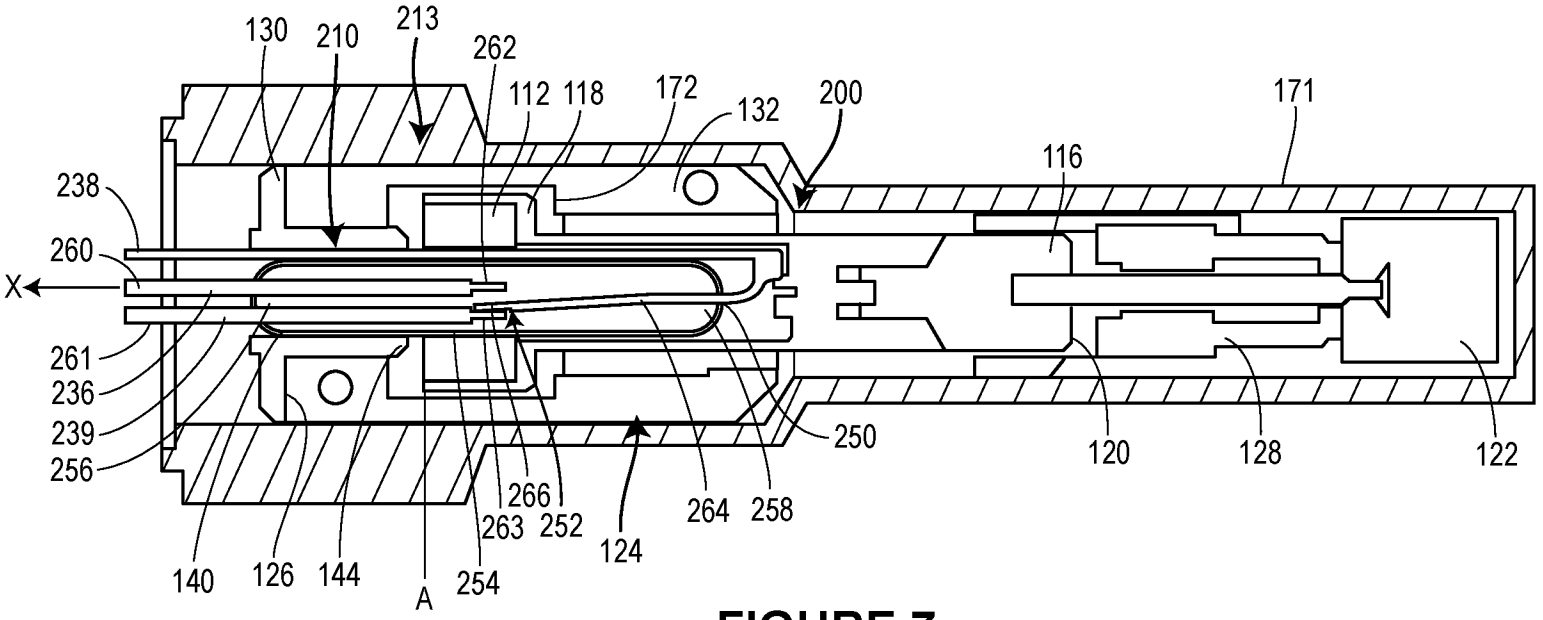
FIG. 7 is a sectional view of another magnetic reed switch assembly of the present disclosure, a magnetic reed switch of the magnetic reed switch assembly in an open state.
Figure 8:
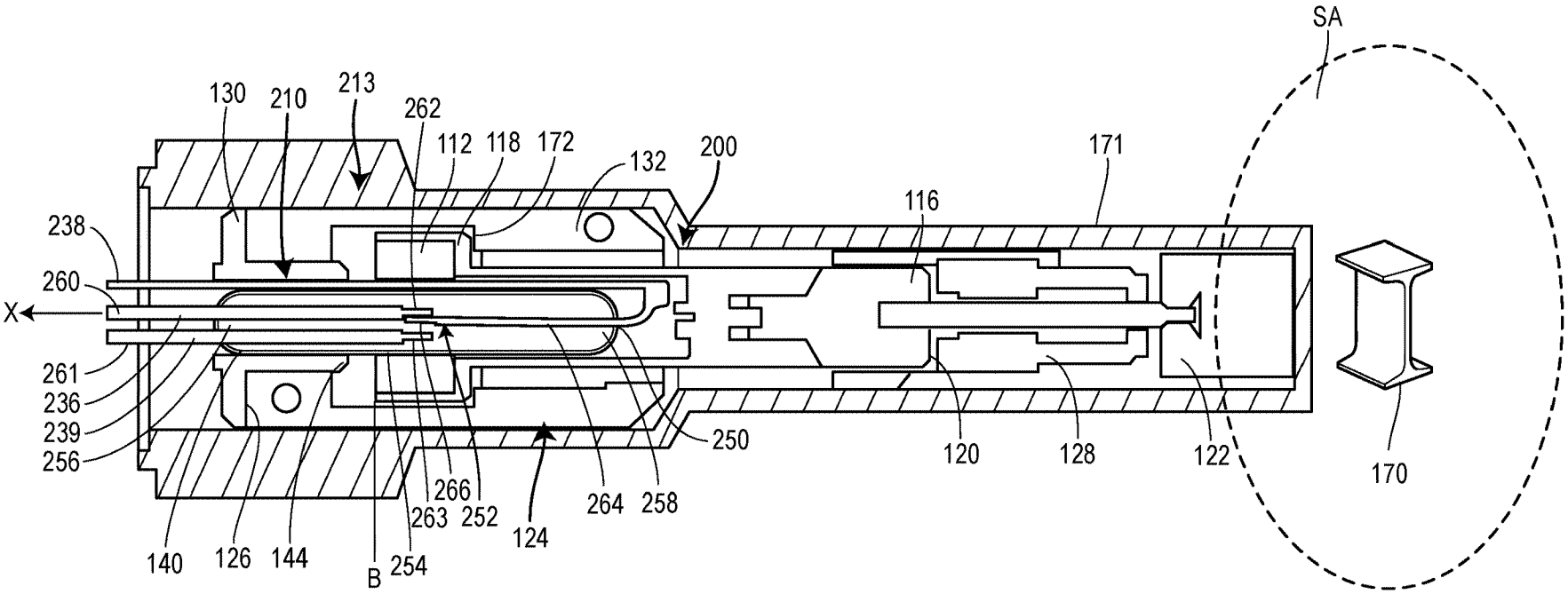
FIG. 8 is a sectional view of another magnetic reed switch assembly of the present disclosure, the magnetic reed switch assembly in a closed state.

Referring now to FIGS. 7-8, another magnetic reed switch assembly 200 constructed in accordance with the present disclosure is depicted. Like the magnetic reed switch assembly 100, the magnetic reed switch assembly 200 is also assembled within TOPWORX GO switch bodytube 171. In addition, the magnetic reed switch assembly 100 is the same as the magnetic reed switch assembly 100 of FIGS. 2-6, for example, except the magnetic reed switch assembly 200 includes a different magnetic reed switch 213. In particular, the magnetic reed switch 213 is a single pole double throw (SPDT) magnetic reed switch (instead of the single pole single throw (SPST) magnetic reed switch 113 of FIGS. 5 and 6). As such, parts of the magnetic reed switch assembly 200 that are the same as parts of the magnetic reed switch assembly 100 are not explained again here for the sake of brevity.

Referring now to FIG. 7, a sectional view of the magnetic reed switch assembly 200 is depicted, with the magnetic reed switch 213 in the open state. The reed switch 210 includes a body 250, such as a tubular body, with an axis X and a pair of electrical contacts 252 disposed in a center area 254 in the tubular body 150. Thus, a portion of the tubular body 250 of the reed switch 110 is disposed in the ring magnet 112. In one example, and like the tubular body 150 of the magnetic reed switch 113, the tubular body 250 comprises glass. Alternatively, the tubular body 250 may also comprise various other shapes and/or combinations of shapes other than a tubular shape and the material may include materials other than glass and still fall within the scope of the present disclosure. In addition, in FIG. 7, the pair of electrical contacts 252 is in a non-contacting position, e.g., the electrical contacts are moved away from each other and do not contact one another, and the magnetic reed switch 213 is in an open state, such as an unactuated state. The ring magnet 112 is in a first position A near the pair of electrical contacts 252 when the reed switch 213 is in the open state. The ring magnet 112 is also moveable along the axis X of the tubular body 250 between the first positon A and a second position B (e.g., FIG. 8), as explained more below.

As further depicted in FIG. 7, the tubular body 250 includes a proximal end 256 and a distal end 258, and the at least one wire 236 comprises a first wire 260 extending into a proximal end 256 of the tubular body 250 of the reed switch 213. The first wire 260 is also coupled to a first electrical contact 262 of the pair of electrical contacts 250. Likewise, a second wire 264 extends into the distal end 258 of the tubular body 250 of the reed switch 213 and is coupled to a second electrical contact 266 of the pair of electrical contacts 252.

Further, the magnetic reed switch 213 also includes a third wire 261 that likewise extends into the proximal end 256 of the tubular body 250 and is disposed one or more of adjacent to or below the first wire 260 also extending into the proximal end 256 of the tubular body 250. The third wire 261 is also coupled to a third electrical contact 263, separate from and in addition to the pair of electrical contacts 252. In the open state depicted in FIG. 7, the second electrical contact 266 of the pair of contacts 252 contacts the third electrical contact 263 and does not contact the first electrical contact 262.

Referring now to FIG. 8, the ring magnet 112 is depicted in the second position B, which is closer to one or both of the pair of electrical contacts 252 and the distal end 258 of the tubular body 250, and the magnetic reed switch 213 is in a closed state. Said another way, the magnetic reed switch 213 is depicted in an actuated state. Specifically, in this example, the ring magnet 112 is moved from the first position A to the second position B in response to the presence of the ferrous target 170. The ferrous target 170 may include any suitable ferrous material and is disposed in the sensing area SA of the sensing magnet 122 (FIG. 8), as explained more below. The ferrous material may be a magnet having an polarity opposite of the polarity of the sensing magnet 122. This causes the pair of electrical contacts 252 to be moved together to the contacting position, and the reed switch 210 to be moved from the open state to the closed state. Specifically, the second electrical contact 266 of the pair of contacts 252 contacts the first electrical contact 262 of the pair of electrical contacts 252 and does not contact the third electrical contact 263 in the closed state of FIG. 8.

When the ferrous target 170 is disposed in a sensing area SA of the sensing magnet 122, such as near the sensing magnet 122, the plunger 116 is actuated in a direction along the axis X toward the ferrous target 170. This actuation causes the ring magnet 112 to move along the axis X of the reed switch 110 from the first position A to the second position B closer to the pair of electrical contacts 252. As a result, the pair of electrical contacts 252 are moved into contact with each other, e.g., are contacting each other, and the reed switch 210 is moved from an open state to a closed state, as depicted in FIG. 8.

More specifically, when the plunger 116 is actuated toward the ferrous target 170, the second electrical contact 266 of the pair of electrical contacts 252 moves into contact the first electrical contact 262 and out of contact with the third electrical contact 263, as depicted in FIG. 8. Thus, the magnetic reed switch 213 is moved from the open state (FIG. 7) to the closed state. In this example, the offset wire 238 is the wire that is common to both sides of the magnetic reed switch 213, such as both the first electrical contact 262 and the third electrical contact 263. In addition, the first electrical wire 260 is the wire that is normally not connected to the common, offset wire 238. Activating the magnetic reed switch 213 due to the presence of the ferrous target 170, for example, closes this circuit. Further, the third electrical wire 161 is the normally closed wire; in other words, the third electrical wire 161 is the wire that is normally connected to the common, offset wire 238 via the second electrical contact 266 and the third electrical contact 263 being in contact, for example. Activating the magnetic reed switch 213 opens this circuit.

When the ferrous target 170 is moved away from the sensing area SA (FIG. 7), the ring magnet 112 is moved along the axis X of the tubular body 250 from the second position B (FIG. 8) back to the first position A, in which the pair of electrical contacts 252 are in the non-contacting position, as depicted in FIG. 7. As a result, the reed switch 210 is moved from the closed state back to the open state in which the pair of electrical contacts 252 is in the non-contacting position, as again depicted in FIG. 7, for example.

So configured, the foregoing magnetic reed switch assembly 100, 200 and magnetic reed switch 113, 213 operate according to the following exemplary method 300. Specifically, a method of changing states of the magnetic reed switch assembly 110, 210, for example, may include moving the ferrous target 170 into the sensing area SA of the sensing magnet 122 coupled to the magnetic reed switch 113, 213 to change a state of the magnetic reed switch 113, 213, the magnetic reed switch 113,213 including the body 150, 250 with a portion disposed within the ring magnet 112. The method may further include in response to the presence of the ferrous target 170 in the sensing area SA, triggering a closed state of the magnetic reed switch 113, 213 via movement of the ring magnet 112 along the axis X of the body 150, 250 of the magnetic reed switch 113, 213 from a first position to a second position and toward the ferrous target 170, causing the pair of electrical contacts 152, 252 disposed within the body 150, 250 of the magnetic reed switch 113, 213 to contact each other.

In one example, the method 300 may further comprise moving the ferrous target 170 away from the sensing area SA of the sensing magnet 122 coupled to the magnetic reed switch 113, 213 and resetting the magnetic reed switch 113, 213 back to an open state via movement of the ring magnet 112 along the axis of the body from the second position back to the first position, causing the pair of electrical contacts 152, 252 to move away from each other.

In another example, triggering the closed state of the magnetic reed switch 113, 213 via movement of the ring magnet 112 along an axis X of the body 150 of the magnetic reed switch 113, 213 from the first position to the second position may comprise moving the ring magnet 112 closer to the pair of electrical contacts 152, 252 disposed within the body 150, 250 of the magnetic reed switch 113, 213 and/or closer to the distal end 158, 258 of the body 150, 250 of the magnetic reed switch 113, 213. In yet another example, triggering the closed state of the magnetic reed switch 113, 213 via movement of the ring magnet 112 along an axis of the body 150 of the magnetic reed switch 113, 213 from the first position to the second position may comprise moving the ring magnet 112, 213 in response to the presence of the ferrous target 170 disposed near the sensing magnet 122 from the first position, in which the pair of electrical contacts 152, 252 are not contacting each other and the magnetic reed switch 113 is in an open state, to the second position, in which the pair of electrical contacts 152, 252 are contacting each other and the magnetic reed switch 113 is in the closed state.

In yet another example, moving the ferrous target 170 away from the sensing area SA of the sensing magnet 122 coupled to the magnetic reed switch 113, 213 and resetting the magnetic reed switch 113, 213 back to the open state via movement of the ring magnet 112 along the axis of the body 150, 250 of the magnetic reed switch 113, 213 from the second position back to the first position comprises moving the ring magnet 112 away from the pair of electrical contacts 152, 252 disposed within the body 150, 250. In yet another example, moving the ferrous target 170 away from the sensing area SA of the sensing magnet 122 coupled to the magnetic reed switch 113, 213 and resetting the magnetic reed switch 113, 213 back to an open state via movement of the ring magnet 112 along the axis of the body 150, 250 of the magnetic reed switch 113, 213 from the second position back to the first position further comprises moving the ring magnet 112 in response to the absence of the ferrous target 170 from the second position back to the first position in which the pair of electrical contacts 152, 252 are not contacting each other, causing the magnetic reed switch 113, 213 to change from the closed state to the open state.

In view of the foregoing, one of skill in art will appreciate advantages of the magnetic reed switch assembly 100, 200 of the present disclosure. For example, utilizing switch technology, the reed switch 110 operates without the presence of a target magnet, which is a desirable feature. In addition, the magnetic reed switch assembly 100, 200 can accommodate various types of magnetic reed switches, such as those described above relative to each of the magnetic reed switch assemblies 100, 200, in accordance with the principles of the present invention. For example, the magnetic reed switch 113 may include only a pair of electrical contacts 152. Alternatively, the magnetic reed switch 213 may include a pair of electrical contacts 252 and a third electrical contact 263. As will be appreciated, various other types of magnetic reed switches may also be used, such as those having more than three electrical contacts, for example, and still fall within the scope of the present disclosure. This flexibility and adaptability of the magnetic reed switch assembly 100, 200 of the present disclosure are further desirable features.

Although certain assemblies and methods have been described herein in accordance with the teachings of the present disclosure, the scope of coverage of this patent is not limited thereto. On the contrary, while the invention has been shown and described in connection with various preferred embodiments, it is apparent that certain changes and modifications, in addition to those mentioned above, may be made. This patent covers all embodiments of the teachings of the disclosure that fairly fall within the scope of permissible equivalents. Accordingly, it is the intention to protect all variations and modifications that may occur to one of ordinary skill in the art.

The following additional considerations apply to the foregoing discussion. Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

Unless specifically stated otherwise, discussions herein using words such as "processing," "computing," "calculating," "determining," "presenting," "displaying," or the like may refer to actions or processes of a machine (e.g., a computer) that manipulates or transforms data represented as physical (e.g., electronic, magnetic, or optical) quantities within one or more memories (e.g., volatile memory, non-volatile memory, or a combination thereof), registers, or other machine components that receive, store, transmit, or display information.

As used herein any reference to "one implementation," "one embodiment," "an implementation," "an example" or "an embodiment" means that a particular element, feature, structure, or characteristic described in connection with the implementation is included in at least one implementation. The appearances of the phrase "in one implementation" or "in one embodiment" or "in one example" in various places in the specification are not necessarily all referring to the same implementation.

Some implementations may be described using the expression "coupled" along with its derivatives. For example, some implementations may be described using the term "coupled" to indicate that two or more elements are in direct physical or electrical contact. The term "coupled," however, may also mean that two or more elements are not in direct contact with each other, but yet still co-operate or interact with each other. The implementations are not limited in this context.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

In addition, use of the "a" or "an" are employed to describe elements and components of the implementations herein. This is done merely for convenience and to give a general sense of the invention. This description should be read to include one or at least one and the singular also includes the plural unless it is obvious that it is meant otherwise.

Moreover, the patent claims at the end of this patent application are not intended to be construed under 35 U.S.C. § 112(f) unless traditional means-plus-function language is expressly recited, such as "means for" or "step for" language being explicitly recited in the claim (s).

While various embodiments have been described above, this disclosure is not intended to be limited thereto. Variations can be made to the disclosed embodiments that are still within the scope of the appended claims.

What is claimed is:

1. A magnetic reed switch assembly, comprising:

a reed switch having a tubular body with an axis and a pair of electrical contacts disposed in the tubular body, the pair of electrical contacts in a non-contacting position in an open state of the reed switch;

a ring magnet having a bore, and a portion of the tubular body of the reed switch disposed within the bore, such that the ring magnet is positioned close to the pair of electrical contacts and movable along the axis of the tubular body between a first position and a second position; and a plunger having a proximal end coupled to the ring magnet and a distal end having a sensing magnet, where, when a target is disposed near the sensing magnet, the plunger moves toward the target causing the ring magnet to move along the axis of the tubular body from the first position to the second position and the reed switch to move from an open state to a closed state, the closed state in which the pair of electrical contacts are contacting each other.

2. The magnetic reed switch assembly of claim 1, wherein the tubular body includes a proximal end and a distal end, and further comprising at least one wire extending outside of the tubular body of the reed switch, the at least one wire comprises a first wire extending into the proximal end of the tubular body of the magnetic reed switch and coupled to a first electrical contact of the pair of electrical contacts, and a second wire extending into the distal end of the tubular body of the magnetic reed switch and coupled to a second electrical contact of the pair of electrical contacts.

3. The magnetic reed switch assembly of claim 2, further comprising a third wire extending into the proximal end of the tubular body of the magnetic reed switch and disposed one or more of adjacent to or below the first wire, wherein the third wire is coupled to a third electrical contact separate from and in addition to the first and second electrical contacts of the pair of electrical contacts, the third electrical contact in contact with the second electrical contact when the magnetic reed switch is in the open state.

4. The magnetic reed switch assembly of claim 1, further including a housing enclosing the ring magnet, the plunger, and a portion of the reed switch, the housing including a proximal end and a distal end, with a first housing portion disposed at the distal end, such that a portion of the tubular body of the reed switch extends outside of the proximal end of the housing, and a portion of the sensing magnet coupled to the distal end of the plunger is disposed outside of the distal end of the housing, and a second housing portion coupled to the first housing portion and including an inside surface limiting movement of the ring magnet.

5. The magnetic reed switch assembly of claim 4, further comprising an offset wire extending from the proximal end of the housing, the offset wire adjacent to and offset from at least one wire extending from the tubular body of the reed switch at the proximal end of the housing, wherein the offset wire extending from the proximal end of the housing and the at least one wire extending from the tubular body of the reed switch are disposed parallel to each other.

6. The magnetic reed switch assembly of claim 1, wherein the tubular body of the reed switch comprises glass, and the target comprises a ferrous target having at least one ferrous material, such as a magnet.

7. The magnetic reed switch assembly of claim 4, wherein the housing further includes an end portion disposed at the proximal end of the housing, the end portion having a bore and an inside surface, the bore for receiving a portion of the tubular body of the reed switch and the inside surface having a hollow projection extending therefrom, the hollow projection receiving another portion of the tubular body of the reed switch.

8. The magnetic reed switch of claim 1, wherein the ring magnet is in the first position near the pair of electrical contacts when the reed switch is in an open state, and the ring magnet is in the second position closer to the pair of electrical contact than the first position when the reed switch is in a closed state.

9. A magnetic reed switch, comprising:

a body with an axis and a pair of electrical contacts disposed in the body, the pair of electrical contacts movable between a non-contacting position in which the pair of electrical contacts are moved away from each other and a contacting position in which the pair of electrical contacts are in contact with each other; and a ring magnet having a bore, and a portion of the body disposed within the bore, where, the ring magnet is positioned in a first position near the pair of electrical contacts when the pair of electrical contacts is in the non-contacting position, and the ring magnet is moved to a second position in response to a presence of a target, the second position closer to the pair of electrical contacts, causing the pair of electrical contacts to be moved to the contacting position, and where the ring magnet is adapted to be coupled to a proximal end of a plunger, the distal end of the plunger having a sensing magnet.

10. The magnetic reed switch of claim 9, where the ring magnet is movable in response to a position of the target disposed near the sensing magnet, the target comprising a ferrous target having at least one ferrous material, such as a magnet.

11. The magnetic reed switch of claim 9, further comprising at least one wire lead extending outside of the body of the reed switch, the body forming a seal with the at least one wire and comprising a proximal end and a distal end, the at least one wire including a first wire extending into the proximal end of the body of the reed switch and coupled to a first electrical contact of the pair of electrical contacts, and a second wire extending into the distal end of the body of the reed switch and coupled to a second electrical contact of the pair of electrical contacts.

12. A method of changing states of a magnetic reed switch, the method comprising:

moving a target into a sensing area of a sensing magnet coupled to a magnetic reed switch to change a state of the magnetic reed switch, the magnetic reed switch including a body with a portion disposed within a ring magnet; and in response to the presence of the target in the sensing area, triggering a closed state of the magnetic reed switch via movement of the ring magnet along an axis of the body of the magnetic reed switch from a first position to a second position and toward the target, causing a pair of electrical contacts disposed within the body of the magnetic reed switch to contact each other.

13. The method of claim 12, wherein triggering the closed state of the magnetic reed switch via movement of the ring magnet along an axis of a body of the reed switch from a first position to a second position comprises moving the ring magnet closer to one or more of the pair of electrical contacts disposed within the body of the magnetic reed switch or a distal end of the body of the magnetic reed switch.

14. The method of claim 12, wherein, the pair of electrical contacts includes a first electrical contact and a second electrical contact, and triggering the closed state of the magnetic reed switch via movement of the ring magnet along an axis of a body of the reed switch from a first position to a second position comprises moving the ring magnet in response to the presence of the target disposed near the sensing magnet from the first position, in which one or more of the pair of electrical contacts are not contacting each other, a third electrical contact is contacting the second electrical contact, and the magnetic reed switch is in an open state, to the second position, in which one or more of the pair of electrical contacts are contacting each other, the second electrical contact is moved away from third electrical contact, and the magnetic reed switch is in the closed state.

* * * * *